US005590978A

United States Patent [19]

Urbank

[11] Patent Number: 5,590,978

[45] Date of Patent: Jan. 7, 1997

[54] ELEVATOR CONSTRUCTION FOR THE LAUNCHING AND RECOVERY OF PERSONAL WATERCRAFT

[76] Inventor: Vincent Urbank, 609 Elizabeth Ter., Toms River, N.J. 08753

[21] Appl. No.: 415,564

[22] Filed: Apr. 3, 1995

[51] Int. Cl.[6] ..... E02B 3/20; B63C 3/06

[52] U.S. Cl. ..... 405/3; 114/48; 405/1

[58] Field of Search ..... 405/3, 1, 7, 218–221; 114/44–48

[56] References Cited

U.S. PATENT DOCUMENTS 3,169,644 2/1965 Godbersen ..... 405/221 X
4,482,268 11/1984 Stevenson et al. ..... 405/3
4,776,726 10/1988 Viles ..... 405/221
5,000,620 3/1991 Bonnema et al. ..... 405/221
5,245,940 9/1993 Rockwood ..... 405/3 X
5,311,970 5/1994 Basta ..... 114/48 X

*Primary Examiner*—Dennis L. Taylor
*Attorney, Agent, or Firm*—Charles I. Brodsky

[57] ABSTRACT

The elevator construction of the invention includes adjustable length elongated posts and tubes to allow for the simple launching and recovery of personal watercraft by lowering and raising a support cradle without the need for any special order, parts or fabrications for situations where wide variation exists in the distance between a dock or seawall and the ground bottom beneath the water.

12 Claims, 2 Drawing Sheets

ELEVATOR CONSTRUCTION FOR THE LAUNCHING AND RECOVERY OF PERSONAL WATERCRAFT

FIELD OF THE INVENTION

This invention relates to the launching and recovery of personal watercraft from a dock or seawall, in general, and to an improvement in an elevator construction for lowering and raising a support cradle disposed beneath the watercraft in lowering it into, and removing it from, the water, in particular.

BACKGROUND OF THE INVENTION

Such a launching and recovery device for personal watercraft is described in U.S. Pat. No. 5,245,940, to Rockwood, and in two United States Patents to Montgomery, U.S. Pat. Nos. 4,983,067 and 5,090,842. Each of these references describe, as is needed, the jetting of a post into the bottom ground beneath the water a sufficient distance to provide support and stability to a hoist which rides a support cradle for the watercraft along the vertical post, and able to pivot the cradle over a dock or seawall to allow the watercraft to be loaded or off-loaded, as well as to allow gear to be stowed in it, and for passengers to enter or leave. In typical arrangements—as for jet ski's of a weight of 250–450 pounds—, such vertical posts oftentimes are driven into the ground a distance of 5 feet or so, and then bolted, or otherwise secured, to the dock or seawall.

As these three prior references illustrate, their constructions each entail welding of a securing bracket to the post—as well as further welding to the post cylindrical tubes which traverse the upper post portion. As will be apparent, this"welding" requires a not insignificant amount of work to be done at the site where the lift device is to be installed.

As will also be apparent to those skilled in the art, such "welding" would, of necessity, have to be done at different points along the posts and may not be uniform from site-to-site, as the depth of water may vary from location to location, and as the dock or seawall may extend different distances above the water's surface from place to place. Thus, whereas one job might involve a post of a given length $L_1$ and a "welding" thereon at a point $P_1$ for one installation, another different installation is likely to require a different length of post $L_2$ and a different positioning $P_2$ where the "welding" is to be done.

Besides this, one skilled in the art would also be quick to see that for differently weighted personal watercraft, the vertical post may very well have to be driven further into the ground then for other constructions. Thus, where a personal watercraft of 800, or 1,000, or 1,200 pounds is to be launched and recovered, the vertical post would have to be jetted further into the bottom ground for the same degree of support and stability than if the cradle were only to be called upon to lift watercraft weighing the 250–450 pounds associated with many types of jet skis.

Taking all this together, it will therefore be seen that the manners of installation described in the Rockwood and Montgomery patents are not suited to a mass-market installation, but require specific parts, individual fabrications and, in general, "special orders" for one installation as compared to another. This makes the installation process both costly and time consuming and something which would be desirable to avoid. As those skilled in the art would appreciate, a more desirable situation would be one where the post, cylindrical tubes and bracket can be of a standardized size, then brought to the job site for erection, cut to the particular size required, and then bolted together there, without the need for "welding" or other unique fabrication techniques.

SUMMARY OF THE INVENTION

As will become clear from the following description, the elevator construction of the present invention incorporates a cylindrical tube enclosed within an upper portion of an elongated vertical post of polygonal shape cross-section also having a lower portion, with both the cylindrical tube and with the upper end of the lower post portion being provided with a plurality of apertures. As will also be described, the angle bracket utilized is secured at one end to the dock or seawall, and at the other end is provided with yet a further plurality of apertures. With the apertures in the cylindrical tube located at its lower end, all that a workman has to do is to measure the height of the dock or seawall above the ground bottom, determine from the weight of the watercraft to be raised and lowered how much of the vertical post must be sunk into the ground to provide the necessary support and stability, then cut the post provided (of a standard, given length) to size, and interfit everything together by aligning the apertures, and then connecting everything together with self-threading bolts. In a preferred embodiment of the invention, to be described, a vertical elongated post of square cross-sectional shape is employed with its apertures cut into one of its corner edges, and the bolts installed, two of them above the point where the angle bracket couples to the corner edge, and two of them below that point. In such manner, as will be understood, a 20 foot or so length of elongated post can be cut down to a 14 foot length where there is a 8 foot distance from the bulkhead to the ground, for a jetting of 6 feet to support a 300 pound jet ski; if the distance from the bulkhead to the ground is 12 feet, then the vertical post brought to the site can be cut down to 18 feet. In the first instance, if the personal watercraft were to weigh more than 300 pounds—say, 800 pounds—, then the vertical post might be cut down from its 20 foot length as brought to the job site to 17 feet—to cover the 8 feet distance of bulkhead to ground, and an additional 9 feet of driving into the ground for providing the increased support and stability required. In all these instances, securement of the component parts will be seen to be by way of a simple "bolting-together", without the need for "welding" or special order fabrications.

BRIEF DESCRIPTION OF THE DRAWINGS

These and other features of the present invention will be more clearly understood from a consideration of the following description, taken in connection with the accompanying drawing, in which.

DETAILED DESCRIPTION OF THE DRAWINGS

Figure 1:
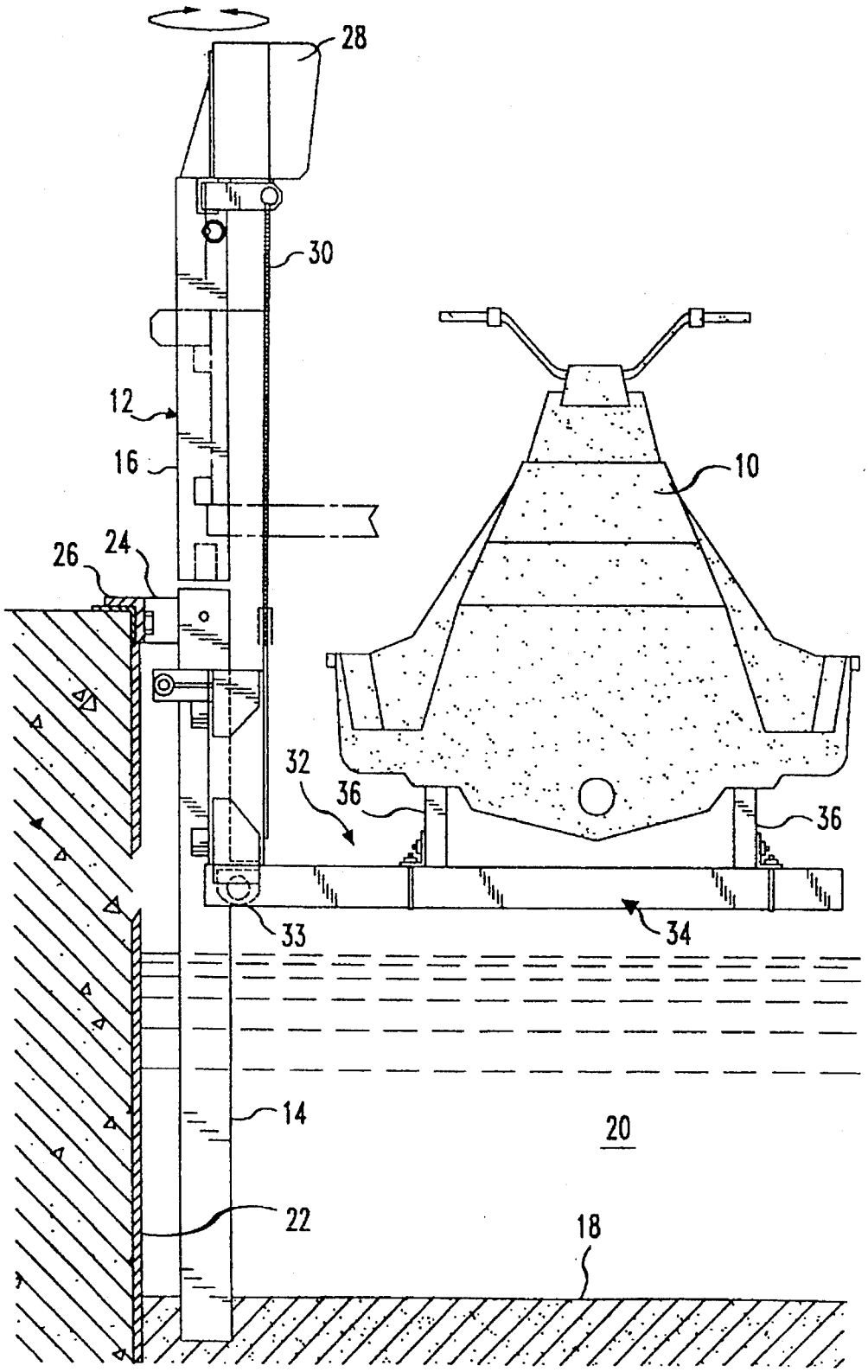
FIG. 1 illustrates a personal watercraft lifting device of the type shown in U.S. Pat. No. 5,245,940 with respect to which the elevator construction of the present invention is particularly attractive.
Figure 2:
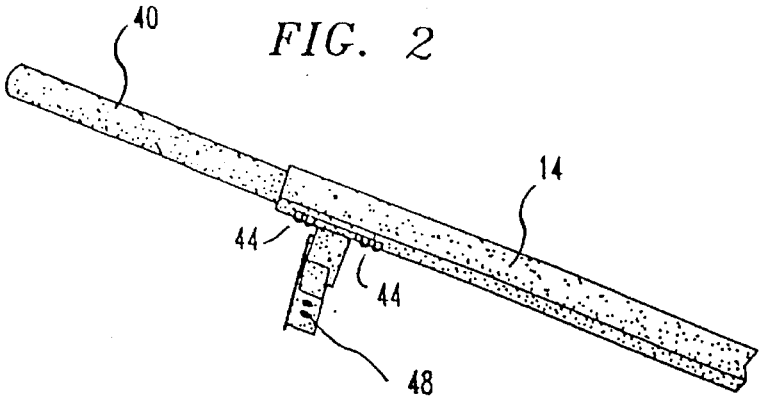
FIGS. 2–4 illustrate different views of the elevator construction of the invention.

In referring to FIG. 1, it is to be understood that it is a simplified showing of the Rockwood construction in U.S. Pat. No. 5,245,940. A load lifting device for the personal watercraft 10 includes an elongated vertical post 12 having a lower post portion 14 and a separable upper post portion 16. As illustrated, the lower post portion 14 is intended to be driven (or jetted) at its lower end into the ground bottom 18 beneath the water 20 adjacent a dock or seawall 22 prior to mounting the upper post portion 16 thereon. A bracket 24 is secured to the dock or seawall 22 to stabilize the upper end 26 of the lower post portion 14, with the upper end 26 being substantially flush with the top of the dock or seawall 22 as shown.

Mounted on the top of the upper post portion 16 is a winch 28 which is provided with a cable 30 as a hoist for coupling the winch to the watercraft supporting cradle 32. As shown, the watercraft supporting cradle 32 is cantilevered on the vertical post 12 and extends laterally from it for vertically sliding movement therealong, as by means of rollers 33, and between the upper and lower post portions 16 and 14, and is arranged to be disposed beneath the watercraft 10 to lift or lower it. The cradle 32 may comprise a horizontal platform 34 consisting of laterally spaced tubular members across which are secured watercraft supporting bunks 36 upon which the watercraft 10 sits when lifted or lowered—or, instead of supporting "bunks" 36, a plurality of rollers may be utilized, as a preference in being able to slide the watercraft onto the cradle from off a dolly for launching, and for loading it back onto the dolly after recovery. As will be understood, the winch 28 and cable 30 thus raise and lower the cradle 32 along the rollers 33 for recovering and launching the watercraft 10—and, depending upon the design (although not shown as such), can be constructed to "swing" the cradle when fully lifted above the dock or seawall 22 to swing in a 360° arc to facilitate the off-loading of the watercraft, the placement of gear upon it, etc.

Figure 3:
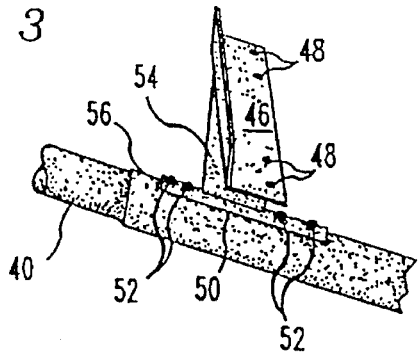
Figure 4:
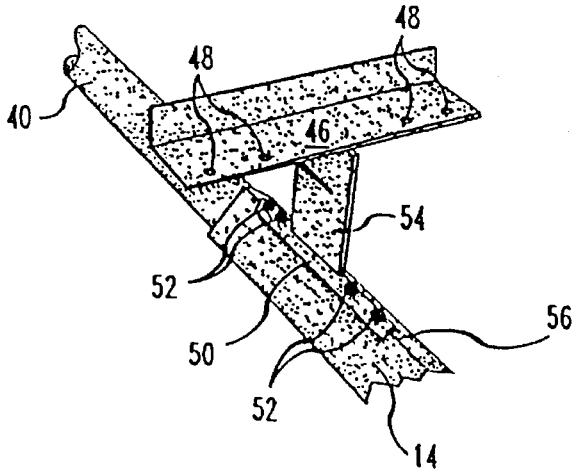
Figure 5:
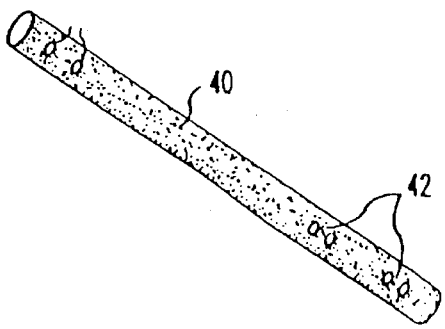
FIG. 5 illustrates a cylindrical tube forming part of the elevated construction of the invention.

In accordance with the present invention as illustrated in FIGS. 2–5, the vertical post 12 may be selected of polygonal cross-sectional shape—and preferably square-shaped. A cylindrical tube 40 is enclosed within the upper post portion 16, having a first plurality of apertures 42 vertically disposed along its length, at the bottom of the tube (FIG. 5). Also shown is a second plurality of apertures 44 vertically disposed along an upper end of the lower post portion 14.

The angle bracket 24 of FIG. 1 is more clearly shown in FIGS. 3 and 4 as including a first horizontally extending surface 46 with a third plurality of apertures 48 horizontally spaced across it for securement to the dock or seawall 22. Such angle bracket 24 also includes a second vertically extending surface 50 with a fourth plurality of apertures 52 vertically spaced across there as well. Likewise shown is a third surface 54 on the angle bracket 24 extending between the surfaces 46, 50 and effectively dividing the apertures 52 such that some of the apertures 52 are located above the surface 54 while some of them are located below the surface 54, as shown. With the lower and upper post portions 14, 16 being of square cross-sectional shape—and preferably fabricated from galvanized iron—, the plurality of apertures 52 are shown as being vertically disposed along a corner edge surface 56 at the upper end 26 of the lower post portion 14.

When it then becomes time to complete the installation of the elevator, instead of having to weld the bracket 24 into position—as with the previously mentioned prior art references—all that is necessary (once the vertical post 12 is cut to its proper length for alignment and for driving into the ground the proper distance) is to join the bracket 24, the lower post portion 14 and the cylindrical tube 40, as by means of self-threading bolts passing through the apertures 42, 44, and 52, and as illustratively shown at 52. This can be done simply, to the extent that an entire installation from start to finish—experience has shown—will take of the order of 60 minutes, or less, all without the need for "welding" or having special order parts fabricated beforehand. With the apertures 48 of the angle bracket 24 then receiving a plurality of bolts to secure the bracket to the dock or seawall 22, the installation is complete, ready for the supporting cradle 32 and the launching of the watercraft for use.

While there have been described what are considered to be preferred embodiments of the present invention, it will be readily appreciated by those skilled in the art that modifications can be made without departing from the scope of the teachings herein. Thus, whereas the invention has been particularly described as it might be used with such personal watercraft as 250–450 pound jet skis, its advantages have been noted to follow equally as well for larger watercraft, even to those weighing up to 2,000 pounds and more. For at least such reason, therefore, resort should be had to the claims appended hereto for a true understanding of the scope of the invention.

I claim:

1. In a launching and recovery device for watercraft to be installed adjacent a dock or seawall of the type including an elongated vertical post having separable upper and lower portions, of polygonal cross-section with the lower portion having a lower end for support on the bottom beneath the water adjacent a dock or seawall and an upper end to be disposed at the upper edge of the dock or seawall, and with the upper post portion having an upper end and a winch fixedly mounted on such upper end and rotatable therewith, a watercraft supporting cradle cantilevered on the elongated vertical post and extending laterally therefrom for vertically sliding movement therealong and between the upper and lower post portions and arranged to be disposed beneath a watercraft to lift the same, a hoist means extending between the winch and cradle for raising and lowering the cradle upon operation of the winch, and rollers disposed between the post and cradle for supporting the cradle on the post for vertical movement, the improvement comprising:

means for rigidly connecting the upper end of the lower post portion to the dock or seawall and for supporting the upper post portion on the lower post portion for rotatable movement therebetween about their common axis;

wherein said means includes a cylindrical tube enclosed within said upper post portion, having a first plurality of apertures vertically disposed along a length thereof;

a second plurality of apertures vertically disposed along an upper end of said lower post portion;

an angle bracket including: a) a first horizontally extending surface to be secured to the dock or seawall, and having a third plurality of apertures horizontally spaced thereacross; b) a second vertically extending surface to be secured to said upper end of said lower post portion, and having a fourth plurality of apertures vertically spaced thereacross; and c) a third surface extending between said first horizontally extending surface and said second vertically extending surface;

first means for securing said first horizontally extending surface of said angle bracket to said dock or seawall via said third plurality of apertures; and second means for securing said second vertically extending surface of said angle bracket, said cylindrical tube and said lower end of said upper post portion in alignment via said first, said second and said fourth plurality of apertures.

2. The improvement of claim 1 wherein said first plurality of apertures is vertically disposed along a lower end of said cylindrical tube.

3. The improvement of claim 1 wherein said second means includes a plurality of self-threading bolts.

4. The improvement of claim 1 wherein said third surface of said angle bracket divides said fourth plurality of vertically spaced apertures into a first section above said third surface and into a second section below said third surface.

5. The improvement of claim 4 in connection with an elongated vertical post having separable upper and lower portions of square cross-section.

6. The improvement of claim 5 wherein said second plurality of apertures are vertically disposed along a corner edge surface of said upper end of said lower post portion when formed of square shape cross-section.

7. The improvement of claim 6 wherein said lower portion of said elongated vertical post is fabricated of galvanized iron.

8. The improvement of claim 1 wherein said third surface of said angle bracket divides said fourth plurality of vertically spaced apertures into a first section of vertically spaced apertures on one side of said third surface and into a second section of vertically spaced apertures on a opposite side of said third surface.

9. The improvement of claim 8 wherein said first plurality of apertures is vertically disposed along a lower end of said cylindrical tube.

10. The improvement of claim 9 in connection with an elongated vertically post having separable upper and lower portions of square cross-section.

11. The improvement of claim 10 wherein said second plurality of apertures are vertically disposed along a corner edge surface of said upper end of said lower post portion when formed of square shape cross-section.

12. The improvement of claim 11 wherein said lower portion of said elongated vertically post is fabricated of galvanized iron.

* * * * *